US006427381B1

(12) United States Patent
Weder

(10) Patent No.: US 6,427,381 B1
(45) Date of Patent: Aug. 6, 2002

(54) POT COVER WITH PRESET FOLDS

(75) Inventor: Donald E. Weder, Highland, IL (US)

(73) Assignee: Southpac Trust Int'l. Inc.

( * ) Notice: Subject to any disclaimer, the term of this patent is extended or adjusted under 35 U.S.C. 154(b) by 0 days.

(21) Appl. No.: 09/938,932

(22) Filed: Aug. 24, 2001

Related U.S. Application Data

(63) Continuation of application No. 09/598,135, filed on Jun. 21, 2000, now Pat. No. 6,311,431.
(60) Provisional application No. 60/140,618, filed on Jun. 23, 1999.

(51) Int. Cl.[7] ..... A47G 7/08
(52) U.S. Cl. ..... 47/72
(58) Field of Search ..... 47/72

(56) References Cited

U.S. PATENT DOCUMENTS

| | | | | |
|---|---|---|---|---|
| 378,610 | A | 2/1888 | Murphy | |
| 681,056 | A | 8/1901 | Millingar | |
| 794,347 | A | 7/1905 | Crouse | |
| 860,904 | A | 7/1907 | Chamberlain | |
| 891,642 | A | 6/1908 | Tietzmann | |
| 991,246 | A | 5/1911 | Rosenfeld | |
| 1,002,346 | A | 9/1911 | Weeks | |
| 1,065,486 | A | 6/1913 | Washburn | |
| 1,069,675 | A | 8/1913 | Claussen | |
| 1,124,618 | A | 1/1915 | House | |
| 1,184,956 | A | 5/1916 | Hoppke | |
| 1,300,164 | A | 4/1919 | Guarding | |
| 1,343,726 | A | 6/1920 | Jakobson | |
| 1,446,014 | A | 2/1923 | Lodge | |
| 1,504,245 | A | 8/1924 | Huntley | |
| 1,714,293 | A | 5/1929 | Batdorf | |
| 1,716,554 | A | 6/1929 | Hoff, Jr. | |
| 1,995,523 | A | 3/1935 | Smith | 229/4.5 |
| 2,016,434 | A | 10/1935 | Huntley | 229/21 |
| 2,019,117 | A | 10/1935 | Conti | 93/60 |
| 2,054,934 | A | 9/1936 | Graffenberger | 229/21 |
| 2,070,747 | A | 2/1937 | Orstrom | 229/37 |
| 2,102,510 | A | 12/1937 | Cecil | 229/52 |
| 2,204,664 | A | 6/1940 | Clark | |
| 2,206,406 | A | 7/1940 | Koch | 229/4.5 |
| 2,344,359 | A | 3/1944 | Lehmann | 229/37 |
| 2,367,749 | A | 1/1945 | Barbieri | 93/60 |

(List continued on next page.)

FOREIGN PATENT DOCUMENTS

| | | |
|---|---|---|
| CH | 560532 | 2/1975 |
| EP | 0586836 | 3/1994 |
| FR | 433587 | 10/1911 |
| FR | 2036163 | 12/1970 |
| FR | 2477107 | 2/1980 |
| FR | 2489126 | 3/1982 |
| FR | 2619698 | 3/1989 |
| JP | 4100338 | 2/1998 |

*Primary Examiner*—Peter M. Poon
*Assistant Examiner*—Jeffrey L. Gellner
(74) *Attorney, Agent, or Firm*—Dunlap Codding & Rogers

(57) ABSTRACT

A cover for covering a flower pot is provided. The cover includes a planar base, a sidewall extending from an outer periphery of the base, and a securing member for securing the sidewall to the flower pot. The sidewall is movable relative to the base between a substantially flattened position wherein the sidewall is in a substantially coplanar relation with respect to the base and an upright position wherein the sidewall and the base cooperate to define a pot receiving space. The sidewall has a plurality of folds formed therein so as to cause the sidewall to take a predetermined shape upon moving the sidewall from the flattened position to the upright position.

14 Claims, 2 Drawing Sheets

U.S. PATENT DOCUMENTS

| | | | | |
|---|---|---|---|---|
| 2,459,073 | A | | 1/1949 | Hamilton | 229/4.5 |
| 2,741,958 | A | | 4/1956 | Bridge, Sr. | 93/60 |
| 2,800,945 | A | | 7/1957 | Schilling | 154/1 |
| 2,952,208 | A | | 2/1960 | Wood | 229/1.5 |
| 2,959,110 | A | | 11/1960 | Thoma | 93/60 |
| 3,007,377 | A | | 11/1961 | Muller | 93/60 |
| 3,215,330 | A | | 11/1965 | Thomas | 229/14 |
| 3,315,018 | A | | 4/1967 | Commeyras | 264/51 |
| 3,329,306 | A | | 7/1967 | Stein | 220/83 |
| 3,820,684 | A | | 6/1974 | Harrison | 206/520 |
| 4,098,177 | A | | 7/1978 | Olney et al. | 99/310 |
| 4,712,725 | A | | 12/1987 | Moore | 229/8 |
| 5,029,412 | A | | 7/1991 | Weder et al. | 47/72 |
| D320,765 | S | | 10/1991 | Sypien | |
| 5,229,182 | A | | 7/1993 | Eisman et al. | 428/80 |
| 5,339,601 | A | | 8/1994 | Weder et al. | |
| D397,639 | S | | 9/1998 | Shea | |
| D413,547 | S | | 9/1999 | Wagner | D11/164 |
| 5,974,736 | A | | 11/1999 | Weder | |
| 5,987,849 | A | | 11/1999 | Weder | |
| 6,079,155 | A | | 6/2000 | Weder | |
| 6,108,973 | A | | 8/2000 | Weder | |
| 6,119,396 | A | | 9/2000 | Weder | |
| 6,173,552 | B1 | | 1/2001 | Weder | |
| 6,256,927 | B1 | | 7/2001 | Weder | |
| 6,308,460 | B1 | * | 10/2001 | Weder | 47/72 |
| 6,311,431 | B1 | * | 11/2001 | Weder | 47/72 |

* cited by examiner

POT COVER WITH PRESET FOLDS

CROSS REFERENCE TO RELATED APPLICATIONS

This application is a continuation of U.S. Ser. No. 09/598,135, filed Jun. 21, 2000, now U.S. Pat. No. 6,311,431 B1, which claims the benefit of U.S. Provisional Application Serial No. 60/140,618, filed Jun. 23, 1999, which is hereby incorporated by reference.

BACKGROUND OF THE INVENTION

1. Field of the Invention

The present invention relates generally to flower pot covers for providing decorative coverings for flower pots and, more particularly, but not by way of limitation, to a pot cover including a sheet of material provided with preset folds, creases, or score lines to control the shape of the pot cover when the pot cover is formed about a flower pot or other plant container.

2. Brief Description of the Related Art

In the florist and nursery industries, it is common to cover flower pots containing plants with sheets of material made of foil, paper, plastic films, and the like to enhance the aesthetic appearance of the potted plants. In addition, a cover serves several other useful functions. For example, covers made of waterproof material such as plastics and foil prevent leakage from the bottom of the pot. Also, light reflective material insulates the soil within the pot against temperature increases from overexposure to sunlight. Pot covers also serve to protect the soil, and to some extent, the foliage, from cold air. Further, pot covers may serve as padding during shipment of fragile pots and as a means for carrying the pots.

Several methods for forming a cover about a flower pot are employed. First, a flower pot can be covered simply by manually forming a sheet of material about the flower pot and securing the sheet of material to the pot with an elastic band or twist tie. This process of forming a sheet of material about a pot is tedious and, unless the former is reasonably skilled, can result in a cover that is unattractive.

Preformed covers for flower pots have been used for many years to accentuate or complement the aesthetic appearance of a floral grouping disposed in the flower pot. Such decorative covers are formed from a flexible sheet of material formed into a shape adapted to receive the flower pot. The preformed cover is simple and efficient in that a pot is merely placed into the preformed cover. The problem with the use of such covers is that the appearance of the cover cannot be altered.

Finally, portable devices for forming a sheet of material about a potted plant have also previously been proposed. One such device is disclosed in U.S. Pat. No. 4,733,521, issued to Donald E. Weder, the present inventor. The Weder 521 patent discloses an apparatus for forming sheet of material about a flower pot. The apparatus includes a frame having an object opening formed through a portion thereof adapted to receive the object. The cover former includes resilient contactors which are adapted to resiliently engage portions of the sheet of material for pressing the engaged portions of the sheet of material against the object when the sheet of material and the object are passed through the object opening. While such devices have met the need for rapid forming of covers about flower pots, as with manually forming a cover, such devices can be tedious to use over an extended period of time, as well as cumbersome to maneuver within a greenhouse.

To this end, a need exists for a pot cover which includes a sheet of material which is provided with preset folds, creases, or score lines to control the shape of the pot cover when the pot cover is formed about a flower pot or other plant container such that the pot cover can be formed about a potted plant in a simple, economical, and efficient manner. It is to such a pot cover that the present invention is directed.

SUMMARY OF THE INVENTION

The present invention is directed to a cover for covering a flower pot. The cover includes a planar base, a sidewall extending from an outer periphery of the base, and a securing member for securing the sidewall to the flower pot. The sidewall is movable relative to the base between a substantially flattened position wherein the sidewall is in a substantially coplanar relation with respect to the base and an upright position wherein the sidewall and the base cooperate to define a pot receiving space. The sidewall has a plurality of folds formed therein so as to cause the sidewall to take a predetermined shape upon moving the sidewall from the flattened position to the upright position.

DETAILED DESCRIPTION OF THE INVENTION

Figure 1:
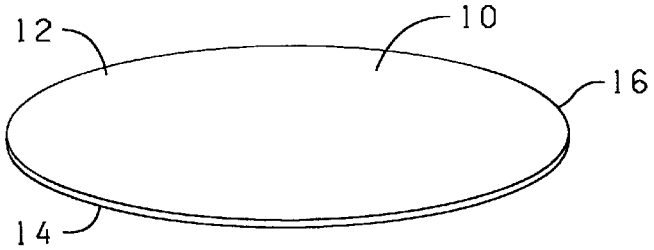
FIG. 1 is a perspective view of a sheet of material used to construct a pot cover in accordance with the present invention.

Shown in FIG. 1 and designated therein by the general reference numeral 10 is a circular sheet of material used to form a pot cover constructed in accordance with the present invention. The sheet of material 10 has a first surface 12, a second surface 14, and an outer periphery 16. It will also be understood that the sheet of material itself may have a shape other than circular, such as square or rectangular. The sheet of material used herein may have any other geometric shape, e.g., trapezoidal, stars, pentagonal, hexagonal, octagonal, or heart-shape, as long as the sheet of material is able to function in accordance with the invention described herein.

Figure 2:
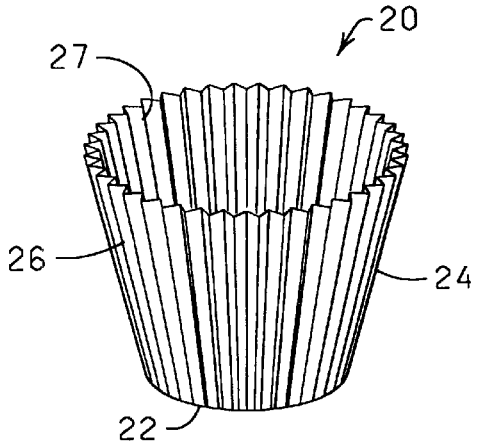
FIG. 2 is a perspective view of a pot cover constructed in accordance with the present invention and shown in a generally upright condition.
Figure 3:
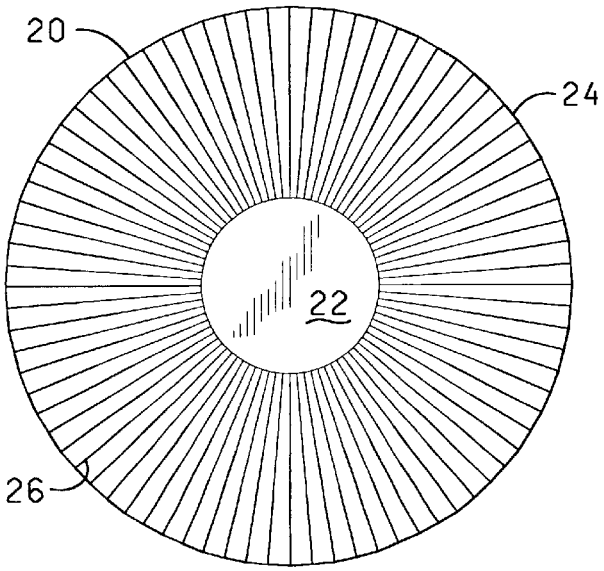
FIG. 3 is a top plan view of the pot cover of FIG. 2 illustrated in a relaxed condition.

The sheet of material 10 is used to form a pot cover 20 (shown in FIGS. 2 and 3). The pot cover 20 is formed from the sheet of material 10 and includes a planar base 22 and a sidewall 24 extending from an outer periphery of the base. The sidewall 24 is formed to include a plurality of folds, flutes, creases, or score lines 26. The sidewall 24 of the pot cover 20 is shown in FIG. 2 as comprising folds 26 which are substantially vertically oriented along their entire length. It will be appreciated, however, that the folds 26 may also be formed such that the folds are more or less randomly oriented directionally rather than uniformly vertically oriented.

The pot cover 20 may be formed by taking the sheet of material 10 and placing it between a male and a female mold (not shown). The male mold is brought into mating engagement with the female mold thereby shaping the pot cover 20. Apparatus and methods for forming folds in a sheet of material are disclosed in detail in U.S. Pat. No. 4,773,182, titled "Article Forming System", issued Sep. 27, 1988, and in U.S. Pat. No. 5,029,412, issued Jul. 9, 1991, titled "Flower Pot Or Flower Pot Cover With Pleated Skirt And Or Base", the disclosures of which are hereby specifically incorporated herein by reference.

The overlapping portions of the folds 26 of the pot cover 20 are not bonded or otherwise connected. Thus, the primary purpose of the folds 26 is not to provide structural integrity to the pot cover 20. To this end, the sidewall 24 is movable relative to the base 22 between a substantially flattened position (FIG. 3) wherein the sidewall 24 is in a substantially coplanar relation with respect to the base 22 and an upright position wherein the sidewall 24 and the base 22 cooperate to define a pot receiving space 27. The folds 26 substantially control the shape of pot cover 20 upon the sidewall 24 being formed about a flower pot or other plant container by an individual or a forming device by causing the sidewall 24 to take a predetermined shape upon moving the sidewall 24 from the flattened position to the upright position. Further, the unconnected folds 26 facilitate shipping and storage of the pot cover 20 in that the pot cover 20 is positionable in the substantially flatted condition, as shown in FIG. 3.

Figure 4:
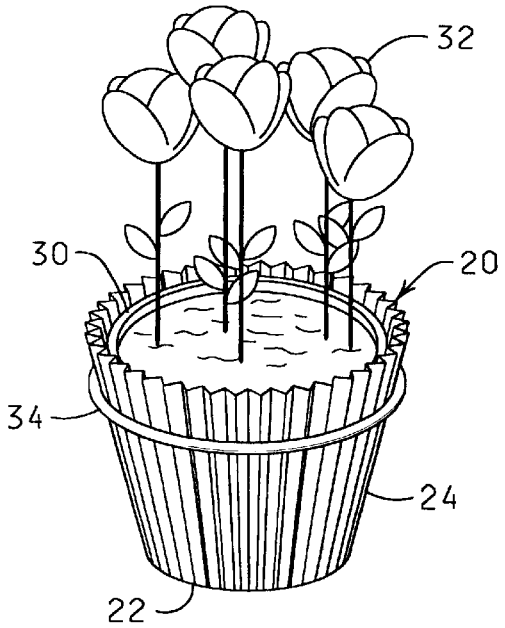
FIG. 4 is a perspective view of the pot cover of FIG. 2 shown positioned and secured about a flower pot.

In use, a pot such as the one designated in FIG. 4 by reference numeral 30 is disposed on the planar base 22 of the pot cover 20. The sidewall 24 of the pot cover 20 is then formed about the pot 30 such that the pot 30 is substantially covered by the sidewall 24. Typically, the pot 30 contains a plant or floral grouping 32 which extends a distance above the upper end of the pot 30. After the pot 30 has been covered by the sidewall 24, the sidewall 24 is secured to the pot 30 with a securing member 34, thereby forming a pot assembly that includes the pot 30 and the pot cover 20. The securing member 34 is shown in FIG. 4 to be a band. However, it will be appreciated that the securing member may also include ties, labels, ribbons, strings, tapes (including single or double-sided adhesive tapes), staples or combinations thereof.

Figure 5:
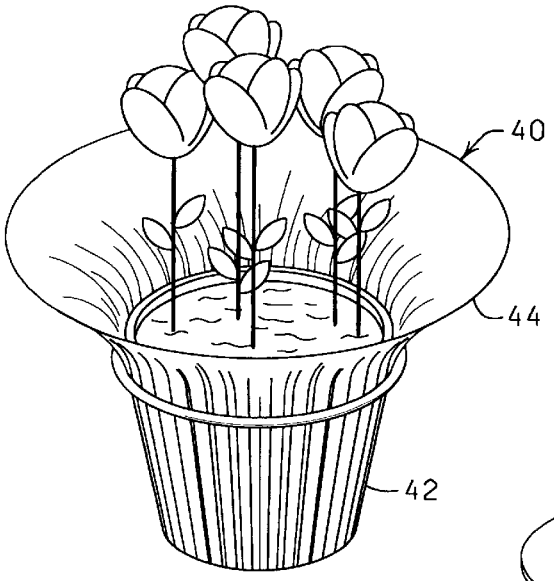
FIG. 5 is a perspective view of another embodiment of a pot cover constructed in accordance with the present invention.

FIG. 5 illustrates another embodiment of a pot cover 40 wherein the pot cover 40 is constructed in a manner identical to the pot cover 20, except the pot cover 40 includes a base portion 42 and a skirt portion 44. The base portion 42 is similar to the sidewall 24 of the pot cover 20. The skirt portion 44 is formed integrally with the base portion 42 and extends angularly relative to the base portion 42. The skirt portion 44 is shown in FIG. 5 as extending outwardly relative to the base portion 42, but the skirt portion 44 could also be formed to extend inwardly relative to the base portion 42. The skirt portion 44 is shown to have no folds. However, it will be understood that the pot cover 40 may be formed so that the skirt portion 44 has a plurality of folds.

Figure 6:
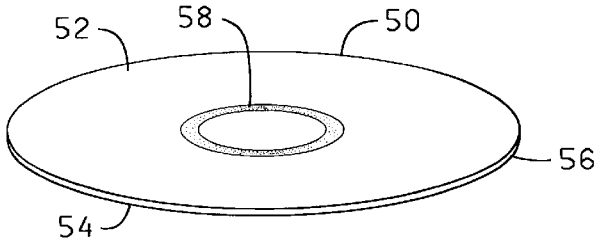
FIG. 6 is a perspective view of another sheet of material used to construct another pot cover in accordance with the present invention.

FIG. 6 illustrates another sheet of material 50 which is similar to the sheet of material 10 in that it has a first surface 52, a second surface 54, and an outer periphery 56. However, the sheet of material 50 further includes a bonding material 58 on at least one of the first and second surfaces 54, 56. The bonding material 58 is shown in FIG. 6 to extend circumferentially about a medial portion of the sheet of material 50.

Figure 7:
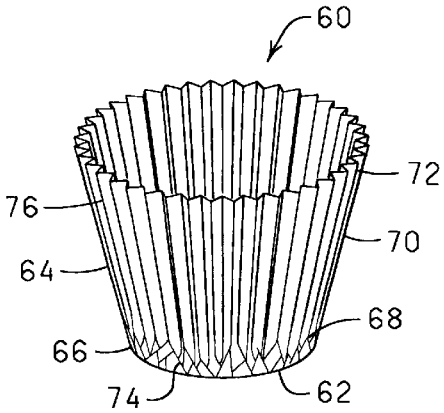
FIG. 7 is a perspective view of another pot cover constructed in accordance with the present invention.

The sheet of material 50 is used to form a pot cover 60 (shown in FIG. 7). The pot cover 60 is formed from the sheet of material 50 and includes a planar bottom 62 and a sidewall 64. The sidewall 64 includes a lower portion 66 extending from the planar bottom 62 to a line 68 positioned above the planar bottom 62 and an upper portion 70 extending from an upper end 72 of the sidewall 64 to the line 68 positioned below the upper end 72. The lower portion 66 comprises a portion of the sidewall 64 which has a plurality of overlapping folds, such as fold 74, which are connected by the bonding material 58. The upper portion 70 comprises a portion of the sidewall 64 having folds 76 which are unconnected, thus the upper portion 70 of the sidewall 64 is left substantially unbonded, resulting in the upper portion 70 of the sidewall 64 having a more billowy or fluted appearance in comparison to the flatter appearance of the bonded lower portion 66. The folds 74 and 76 of the sidewall 64 are shown in FIG. 7 as comprising folds which are substantially vertically oriented along their entire length. It will be appreciated, however, that the folds may also be formed such that the folds are more or less randomly oriented directionally rather than uniformly vertically oriented.

Figure 8:
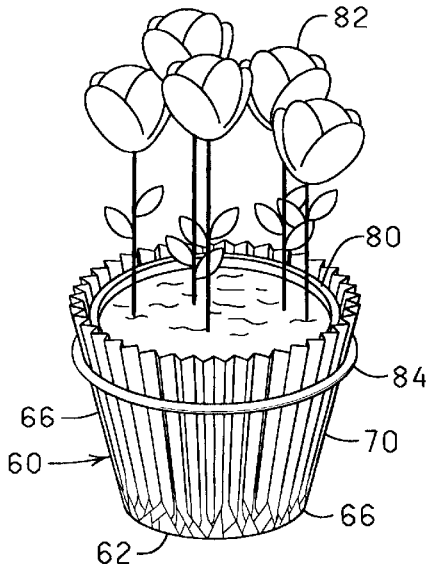
FIG. 8 is a perspective view of the pot cover of FIG. 7 shown positioned and secured about a flower pot.

In use, a pot such as the one designated in FIG. 8 by reference numeral 80 is disposed on the planar bottom 62 of the pot cover 60 and into the lower portion 66 of the sidewall 64. The upper portion 70 of the sidewall 64 of the pot cover 60 is then formed about the pot 80 such that the pot 80 is substantially covered by the sidewall 64. Typically, the pot 80 contains a plant or floral grouping 82 which extends a distance above the upper end of the pot 80. After the pot 80 has been covered by the sidewall 64, the sidewall 64 is secured to the pot 80 with a securing member 84. The securing member 84 is shown in FIG. 8 to be a band. However, it will be appreciated that the securing member may also include ties, labels, ribbons, strings, tapes (including single or double-sided adhesive tapes), staples or combinations thereof. It will be appreciated that the pot cover 60 may also be formed to have a skirt, similar to that of the pot cover 40 described above.

The sheets of material 10 and 50 used in accordance with the present invention may be constructed from a material selected from the group of materials consisting of paper (treated or untreated), cellophane, foil, polymer film, fabric (natural or synthetic, woven or nonwoven), or burlap or combinations or laminations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The sheets of material 10 and 50 or other embodiments described herein may vary in color. Further, the sheets of material may consist of designs or decorative patterns which are printed, etched, and/or embossed thereon using inks or other printing materials. An example of an ink which may be applied to the surface of the sheets of material described herein is described in U.S. Pat. No. 5,147,706, entitled "Water Based Ink On Foil And/Or Synthetic Organic Polymer" issued to Kingman on Sep. 15, 1992 and which is hereby incorporated herein by reference. In addition, the sheets of material described herein may have various colorings, coatings, flocking and/or metallic finishes, or other decorative surface ornamentation applied separately or simultaneously or may be characterized totally or partially by pearlescent, translucent, transparent, iridescent or the like, =qualities. Each of the above-named characteristics may occur alone or in combination and may be applied to the upper and/or lower surface of the sheets of material described herein. Moreover, each surface of the sheets of material described herein may vary in the combination of such characteristics. The sheets of material described herein may be opaque, translucent or partially clear or tinted transparent.

The sheets of material described herein may be constructed of a single layer of material or a plurality of layers of the same different types of materials. Any thickness of the sheet of material may be utilized in accordance with the present invention as long as the sheet of material is formable into a pot cover with a skirt, as described herein. The layers of material comprising the sheet of material may be connected together or laminated or may be separate layers, and the layers of material comprising the sheet of material need not be uniform in shape or composition.

As noted above, the sheet of material may be constructed of a single layer of material or a plurality of layers of the same or different types of materials. Any thickness of the sheet of material may be utilized in accordance with the present invention as long as the sheet of material may be formed into a flower pot cover, as described herein. Additionally, an insulating material such as bubble film, preferable as one of two or more layers, can be utilized in order to provide additional protection for the item wrapped therein.

A decorative pattern, such as a color and/or an embossed pattern, and/or other decorative surface ornamentation may be applied to the inner peripheral surface and/or the outer peripheral surface of the sheet or cover or portions thereof including, but not limited to printed design, coatings, colors, flocking or metallic finishes. The sheet of material also may be totally or partially clear or tinted transparent material.

The term "bonding material" when used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes material which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer which may be applied to the sheet of material and, in this instance, heat, sound waves, or vibrations, also must be applied to effect the sealing.

The sheet of material used herein may further comprise at least one scent (not indicated in the figures). Examples of scents utilized herein include (but are not limited to) floral scents (flower blossoms, or any portion of a plant), food scents (chocolate, sugar, fruits), or herb or spice scents (cinnamon), and the like. Additional examples of scents include flowers (such as roses, daisies, lilacs), plants (such as fruits, vegetables, grasses, trees), foods (for example, candies, cookies, cake), food condiments (such as honey, sugar, salt), herbs, spices, woods, roots, and the like, or any combination of the foregoing. Such scents are known in the art, and are commercially available.

The scent may be disposed upon the sheet of material 10 by spraying the scent thereupon, painting the scent thereupon, brushing the scent thereupon, lacquering the scent thereupon, immersing the sheet of material in a scent-containing liquid, exposing the sheet of material to scent-containing gas, or any combination thereof.

The scent may be contained within a lacquer, or other liquid, before it is disposed upon the sheet of material 10. The scent may also be contained within a dye, ink, and/or pigment (not shown). Such dyes, inks and pigments are known in the art, and are commercially available, and may be disposed upon or incorporated in the sheet of material 10 by any method described herein or known in the art.

The term "floral grouping" where used herein, means cut fresh flowers, artificial flowers, a single flower, other fresh and/or artificial plants or other floral materials and may include other secondary plants and/or ornamentation or artificial or natural materials which add to the aesthetics of the overall floral arrangement. The floral grouping comprises a bloom or foliage portion and a stem portion. However, it will be appreciated that the floral grouping may consist of only a single bloom or only foliage (not shown). The term "floral grouping" may be used interchangeably herein with the term "floral arrangement".

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A cover for covering a flower pot, comprising:

a planar base having an outer periphery;

a sidewall integral with the outer periphery of the planar base, the sidewall being movable relative to the planar base between a substantially flattened position wherein the sidewall is in a substantially coplanar relation with respect to the planar base and an upright position wherein the sidewall and the planar base cooperate to define a pot receiving space, the sidewall having a plurality of subtratally uniform folds formed therein so as to cause the sidewall to take a predetermined shape upon moving the sidewall from the substantially flattened position to the upright position; and a securing member positionable about the sidewall for securing the sidewall to the flower pot when the sidewall is in the upright position.

2. The cover of claim 1 wherein all the folds of the sidewall are unbonded.

3. The cover of claim 1 wherein the folds of the sidewall are vertically oriented when the sidewall is in the upright position.

4. The cover of claim 1 wherein the sidewall includes a base portion and a skirt portion, the base portion extends from the planar base and the skirt portion extends from the base portion at an angular relationship with respect to the base portion when the sidewall is in the upright position.

5. The cover of claim 4 wherein all the folds of the sidewall are unbonded.

6. The cover of claim 4 wherein the skirt portion contains no folds.

7. The cover of claim 4 wherein the skirt portion extends in an outwardly direction relative to the base portion of the sidewall.

8. A flower pot assembly comprising:

a flower pot; and a cover for covering the flower pot, the cover comprising:

a planar base having an outer periphery;

a sidewall integral with the outer periphery of the planar base, the sidewall being movable relative to the planar base between a substantially flattened position wherein the sidewall is in a substantially coplanar relation with respect to the planar base and an upright position wherein the sidewall and the planar base cooperate to define a pot receiving space, the sidewall having a plurality of subtantialy uniform folds formed therein so as to cause the sidewall to take a predetermined shape upon moving the sidewall from the substantially flattened position to the upright position; and a securing member positionable about the sidewall for securing the sidewall to the flower pot when the sidewall is in the upright position.

9. The pot assembly of claim 8 wherein the folds of the sidewall are unbonded.

10. The pot assembly of claim 8 wherein the folds of the sidewall are vertically oriented when the sidewall is in the upright position.

11. The pot assembly of claim 8 wherein the sidewall includes a base portion and a skirt portion, the base portion extends from the planar base and the skirt portion extends from the base portion at an angular relationship with respect to the base portion when the sidewall is in the upright position.

12. The flower pot assembly of claim 11 wherein the overlapping portions of all the folds of the sidewall of the cover are unbonded.

13. The flower pot assembly of claim 12 wherein the skirt portion contains no folds.

14. The flower pot assembly of claim 11 wherein the skirt portion of the sidewall of the cover extends in an outwardly direction relative to the base portion of the sidewall.

* * * * *

UNITED STATES PATENT AND TRADEMARK OFFICE

CERTIFICATE OF CORRECTION

PATENT NO. : 6,427,381 B1
DATED : August 6, 2002
INVENTOR(S) : Donald E. Weder

It is certified that error appears in the above-identified patent and that said Letters Patent is hereby corrected as shown below:

Column 6,
Line 33, change word “substratally” to word -- substantially --.

Column 7,
Line 12, change word “subtantialy” to word -- substantially --.

Signed and Sealed this

Twenty-fifth Day of January, 2005

JON W. DUDAS
*Director of the United States Patent and Trademark Office*